United States Patent [19]

Tateda et al.

[11] Patent Number: 4,734,554

[45] Date of Patent: Mar. 29, 1988

[54] HEATING APPARATUS WITH HUMIDITY SENSOR

[75] Inventors: Koichi Tateda, Yao; Tatsuya Tsuda, Osaka; Yuzi Ando, Naraken, all of Japan

[73] Assignee: Sharp Kabushiki Kaisha, Osaka, Japan

[21] Appl. No.: 828,887

[22] Filed: Feb. 13, 1986

[30] Foreign Application Priority Data

Feb. 15, 1985 [JP] Japan ..... 60-20636[U]
Feb. 15, 1985 [JP] Japan ..... 60-20638[U]

[51] Int. Cl.[4] ..... H05B 6/68

[52] U.S. Cl. ..... 219/10.55 B; 219/10.55 E; 219/492; 73/73; 73/336.5; 99/325; 374/149

[58] Field of Search ..... 219/10.55 B, 10.55 E, 219/10.55 R, 492; 73/73, 75, 336.5; 374/149; 99/325

[56] References Cited

U.S. PATENT DOCUMENTS 2,733,607 2/1956 Miller ..... 73/336.5
3,719,810 3/1973 Ahlquist et al. ..... 73/336.5 X
3,813,927 6/1974 Furgason ..... 73/73
4,316,068 2/1982 Tanabe ..... 219/10.55 B
4,379,406 4/1983 Bennewitz et al. ..... 73/336.5
4,501,147 2/1985 Niwa ..... 219/10.55 B

*Primary Examiner*—Philip H. Leung
*Attorney, Agent, or Firm*—Birch, Stewart, Kolasch & Birch

[57] ABSTRACT

A heating apparatus contains a humidity sensor for detecting vapor amount generating from the heated object and a control unit for controlling the heating time on the basis of the signal output from the humidity sensor. The humidity sensor includes a first heat sensor for detecting the atmospheric temperature and a second heat sensor which is self-heated or heated by a heating source. The control unit includes a comparator for comparing the temperature change of the first heat sensor with that of the second heat sensor which change is caused by vapor generating from the heated object, and a control circuit for controlling the additional heating time on the basis of the time the signal output from the comparator took to reach the value preset for each kind of heated objects, when the preset value is reached.

19 Claims, 7 Drawing Figures

HEATING APPARATUS WITH HUMIDITY SENSOR

BACKGROUND OF THE INVENTION

The present invention relates to a humidity detecting circuit with a humidity sensor for detecting the completion of the heating of an object and more specifically to a heating apparatus such as a microwave oven having a humidity sensor for detecting the completion of the heating of an food.

The conventional microwave oven uses two self-heated thermistors as a humidity sensor, the one being sealed in a dry atmosphere with 0 g/m$^3$ absolute humidity, and the other being exposed to the exhaust gas discharged from the heating furnance. The humidity sensor of this type involves two thermistors as a pair that have virtually the same temperature coefficient and the same resistance at a high temperature. Besides, it is required to seal one of the pair in a dry atmosphere, causing high production cost.

SUMMARY OF THE INVENTION

An object of the present invention is to provide a humidity detecting circuit with a humidity sensor capable of detecting moisture content at a low cost.

Another object of the present invention is to provide a heating apparatus with a humidity sensor capable of detecting the moisture content at a low cost.

An additional object of the present invention is to provide a low cost humidity detecting circuit that has a humidity sensor composed of heat sensors with different temperature properties for accurate humidity detection.

Other objects and further scope of applicability of the present invention will become apparent from the detailed description given hereinafter. It should be understood, however, that the detailed description and specific examples, while indicating preferred embodiments of the invention, are given by way of illustration only; various changes and modifications within the spirit and scope of the invention will become apparent to those skilled in the art from this detailed description.

Briefly described, in accordance with the present invention, a heating apparatus contains a humidity sensor for detecting a vapor amount generating from the heated object and a control unit for controlling the heating duration according to a signal output from the humidity sensor, the humidity sensor comprising a first heat sensor for measuring the atmospheric temperature and a second heat sensor which is self-heated or heated by a separate heating source, the control unit comprising comparator for comparing output signals from the first and second heat sensors to determine the difference between the temperature changes of the first and second heat sensors caused by vapor generating from the heated object, and a control circuit which, when the signal output of the comparator reaches the value preset for each specific kind of heated object, controls the subsequent heating time on the basis of the time the signal output of the comparator took to reach the preset value from a heating start.

A humidity detecting circuit of another embodiment of the present invention comprises a humidity sensor for detecting the moisture content of the atmosphere, the humidity sensor being composed of a first heat sensor for measuring the atmospheric temperature and a second heat sensor which is self-heated or heated by a separate heating source, a comparator for comparing the detection signal of the first heat sensor with that of the second heat sensor, the first and second heat sensors having different temperature characteristics so that the voltage thereacross change at a same rate only when the atmospheric temperature fluctuates in a constant humidity.

BRIEF DESCRIPTION OF THE DRAWINGS

The present invention will become more fully understood from the detailed description given hereinabelow and the accompanying drawings which are given by way of illustration only, and thus are not limitative of the present invention and wherein.

DETAILED DESCRIPTION OF THE INVENTION

Figure 3:
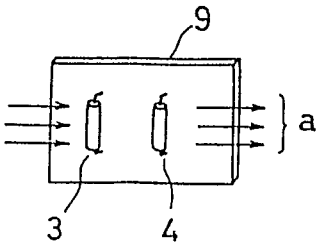
FIG. 3 is a perspective view of a humidity sensor in the microwave oven of FIG. 2.

An embodiment of the present invention is now described below with reference to FIGS. 1 through 3. A heating apparatus of the present invention contains a humidity sensor 1 for detecting vapor amount generating from the heated object and a control unit 2 for controlling the heating time according to a signal output from the humidity sensor 1. The humidity sensor 1 comprises a first heat sensor 3 for measuring the atmospheric temperature and a second heat sensor 4 which is either self-heated or heated by a separate heating source. The control unit 2 comprises a comparator 5 for comparing output signals from the first and second heat sensors and for amplifying the difference between the output signals from the first and second heat sensors 3 and 4 to determine the difference between the temperature changes of the first and second heat sensors 3 and 4, caused by vapor generating from the heated object, and a control circuit 6 which controls the subsequent heating time on the basis of the time the signal output from the comparator took to reach the value preset from a heating start, when the preset value is reached.

Figure 1:
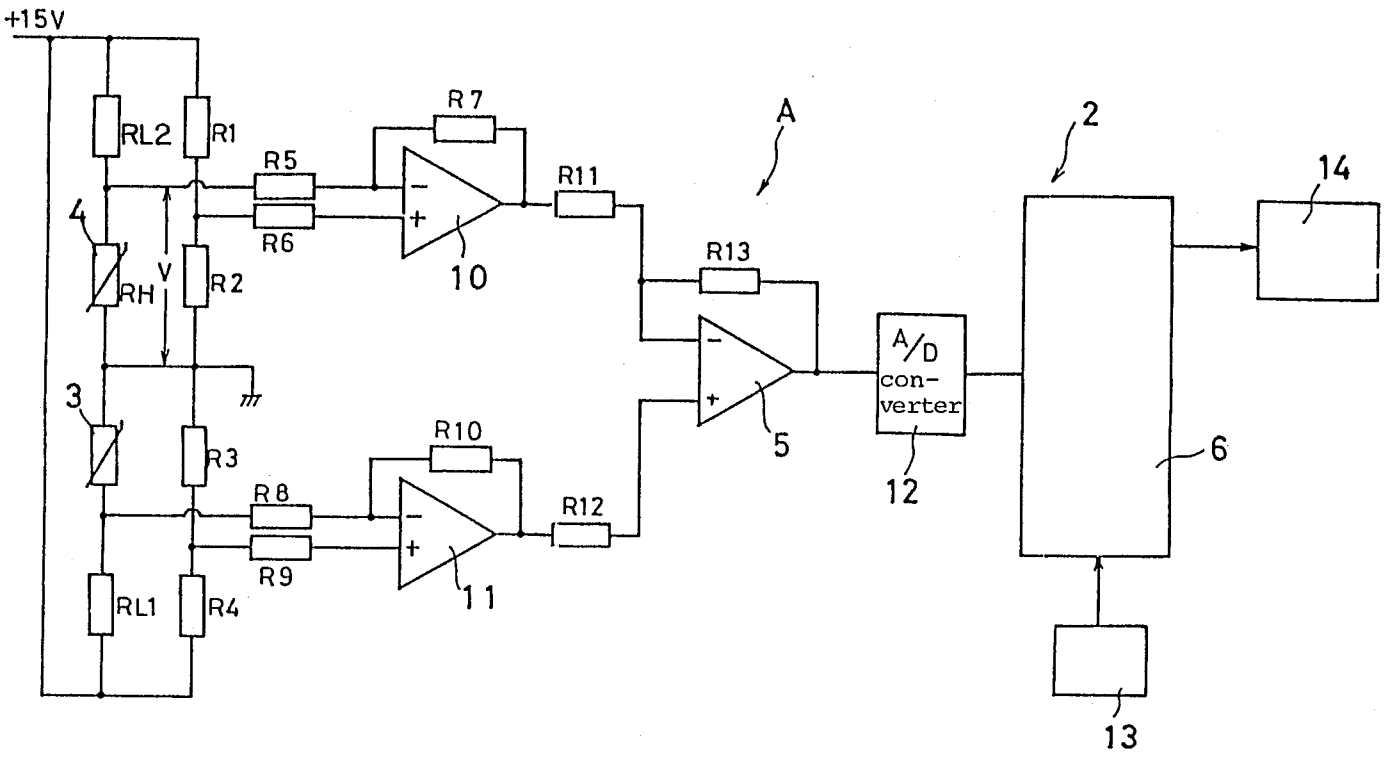
FIG. 1 is a circuit diagram showing a detection circuit for detecting the completion of the heating of an object in a heating apparatus of an embodiment of the present invention.

FIG. 1 is a circuit diagram showing the detection circuit for detecting the completion of the heating of an object. The first and second heat sensors 3 and 4 composed of metal thin film resistors, thermistors, semiconductors, or the like are positioned, as shown in FIG. 2, in an exhaust duct 8 through which vapor generated in the heating chamber 7 is exhausted outside the chamber. As shown in FIG. 3, the first and second heat sensors 3 and 4 are mounted as exposed on a mounting plate 9 provided in the exhaust duct 8. The first heat sensor 3 is provided with a function to measure the temperature of the vapor-containing exhaust gas discharged from the heating chamber 7. The second heat sensor 4 is self-heated to a high temperature. The second heat sensor 4 may be heated by any of a number of heating sources such as a heater.

Humidity detection with thin film heat sensors is described below to specify the humidity detecting principle of the present invention. The fundamental principle is the same as that of a hotwire type flowmeter. Under a thermal equilibrium state with a constant temperature of the second heat sensor 4, the law of conservation of energy as expressed by the equation (1) applies.

$$\int\int\int \frac{dqg}{dt}\,dv = \int\int \frac{dqt}{dt}\,ds \tag{1}$$

in which qg: heat value per unit volume qt: cooling heat transfer amount per unit area The left side of the equation represents the heat generated by the second heat sensor 4 for each unit time, and the right side represents the total heat transfer amount from the surface of the second heat sensor 4 to the exhaust gas flow. Applying Fourier's law and Ohm's law, well known in the electrothermics field, to the equation (1), we obtain the equation:

$$\int\int\int \rho \cdot J^2 dv = \int\int h \cdot (Tw - Tf) ds \tag{2}$$

in which $\rho$: specific electric resistance of second heat sensor 4

J: current density h: local heat transfer coefficient

Tw: wall temperature of second heat sensor 4

Tf: temperature of exhaust gas from heating chamber

Integrating the equation (2), we obtain, $$RH \cdot I^2 = hm \cdot (Tw - Tf) \cdot S \tag{3}$$

in which

RH: electric resistance of second heat sensor 4

I: current flowing through second heat sensor 4 hm: mean heat transfer coefficient

S: surface area of second heat sensor 4

Mean heat transfer coefficient depends on the mean velocity of the exhaust gas flow as well as on vapor content in the exhaust gas flow. Since the mean exhaust gas flow velocity depends solely on the exhaust system employed by the microwave oven, the mean heat transfer coefficient varies with the vapor content in the exhaust gas. Accordingly, if "Tw" is constant, the mean heat transfer coefficient "hm" is determined by measuring "Tf" with the first heat sensor 3 and by measuring "RH" or "I". Thus, the vapor content in the exhaust gas is obtained. Specifically, measure the voltage drop at the second heat sensor 4 of FIG. 1.

$$V = RH \cdot I \tag{4}$$

$$I = V/RH \tag{4A}$$

$$V\text{ref} = (RL2 + RH) \cdot I \tag{5}$$

From the equations (4) and (5), we obtain, $$RH = \frac{RL2 \cdot V}{Vref - V} \tag{6}$$

RH and I are thus obtained with the above equations. Then, using the equation (3), we can determine "hm" and accordingly estimate the vapor content in the exhaust gas flow.

The detection circuit shown in FIG. 1 is an example based on the above principle.

The detection circuit A includes a first amplifier 10 for detecting change in the voltage across the second heat sensor 4 and a second amplifier 11 for detecting change in the voltage across the first heat sensor 3. The voltage by the second heat sensor 4 and a current limiting resistor RL2 is input to the negative terminal, and the reference voltage by resistors R1 and R2 is input to the positive terminal of the first amplifier 10. The voltage by the first heat sensor 3 and a current limiting resistor RL1 is input to the negative terminal, and the voltage by resistors R3 and R4 is input to the positive terminal of the second amplifier 11. The output of the first amplifier 10 is input to the negative terminal, and the output of the second amplifier 11 to the positive terminal of the comparator 5. The difference between the voltage changes across the first and second heat sensors 3 and 4 is output from the comparator 5 and input through an A/D converter 12 into the control circuit 6. The control circuit 6 is mainly composed of a micro computer which contains a data RAM (randam-access-memory), program ROM (read-only-memory) and ALU (arithmetic-logic-unit), and is driven by a reference clock generator. The control circuit 6 is connected to a setting device 13 which selects the particular kind of object to be heated. When the signal output of the A/D converter 12 reaches the value preset by the setting device 13 for the particular kind of heated object, the control circuit 6 calculates additional heating time requirement on the basis of the time the signal output took to reach the preset value from the heating start. When the calculated time elapses, the control circuit 6 outputs a stop signal to heating means 14 (a magnetron or a heater). In FIG. 1, R5 through R13 represent amplification factor-controlling resistors.

Figure 2:
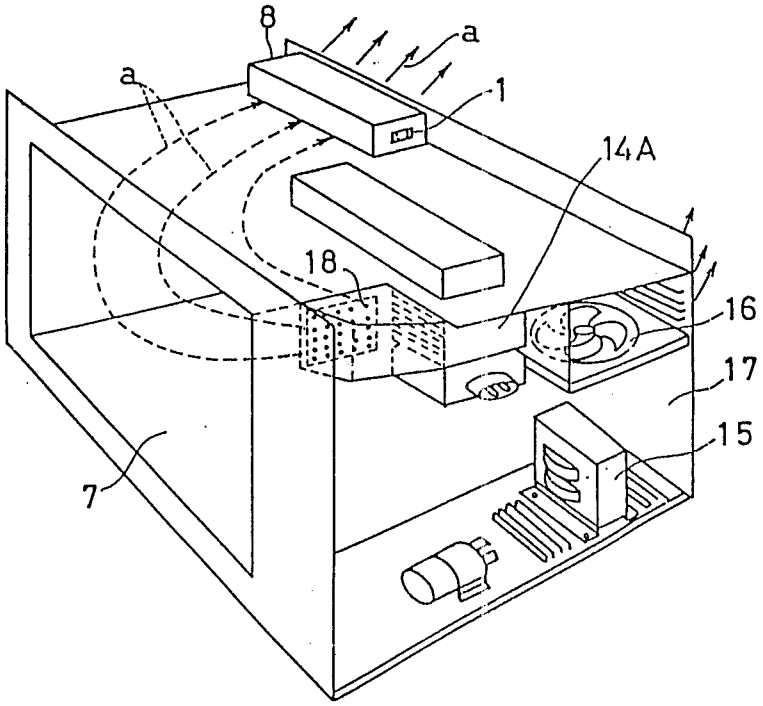
FIG. 2 is a perspective view of a microwave oven as an example of the heating apparatus of the present invention.

Referring to FIG. 2, a magnetron 14A, a high tension transformer 15 and a cooling fan 16 for cooling the magnetron 14A and high tension transformer 15 are housed in the microwave oven main frame 17 outside the heating chamber 7. Heat from the magnetron 14A itself is released through the vent hole 18 formed in the chamber wall and discharged to the exhaust duct 8 together with hot air "a" generating from the object heated in the chamber 7.

According to the present embodiment, the humidity sensor 1 is mounted in the exhaust duct 8. It may be mounted elsewhere if it is in the exhaust system for releasing vapor generating from the object heated in the chamber 7.

With the construction mentioned above, when vapor generated from the heated object is discharged to the exhaust duct 8, the humidity sensor 1 in the exhaust duct 8 detects the vapor amount, thus detecting the state of the heated object. More specifically, the first and second amplifiers 10 and 11 detect changes in the voltages across the second and first heat sensors 4 and 3, respectively. In other words, temperature changes of the first and second heat sensors 3 and 4 are detected. Then, the difference between the voltage changes of the first and second heat sensors 3 and 4 is amplified to a magnitude large enough to be converted to a digital signal by the A/D converter 12. The digital data from the A/D converter 12 is then input into the control circuit 6. When the input data reaches the value preset for a specific kind of heated object, the control circuit 6 changes over the output of the microwave oven as specified for the particular kind of heated object, and calculates any additional heating time requirement for the particular heated object, on the basis of the time taken to reach the preset value from the heating start. When the additional heating time elapses, the control circuit 6 outputs a stop signal to the heating means 14. Thus, the heating operation is completed.

It should be understood that the invention is not limited by the above example and that various changes and modifications may be made in the invention without departing from the spirit and scope thereof.

As is obvious from the above description, the heating apparatus of an embodiment of the present invention contains the humidity sensor for detecting the vapor amount generated from the heated object and the control unit for controlling the heating time in accordance with a signal output from the humidity sensor. The humidity sensor comprises the first heat sensor for measuring the atmospheric temperature and the second heat sensor which is self-heated or heated by a separate heating source. The control unit comprises the comparator for comparing the temperature changes of the first and second heat sensors to obtain the temperature difference caused by vapor generated from the heated object, and the control circuit for controlling the subsequent heating time on the basis of the time the signal output from the comparator took to reach the value preset for each kind of heated object from the heating start, when the preset value is reached.

According to the present invention, therefore, humidity can be easily determined by simply measuring the atmospheric temperature with the first heat sensor while heating the second heat sensor; it is not necessary to seal one of the two heat sensors of the humidity sensor in a dry atmosphere with 0 g/m$^3$ absolute humidity as required in the prior art. The manufacturing cost is accordingly reduced.

Figure 4:
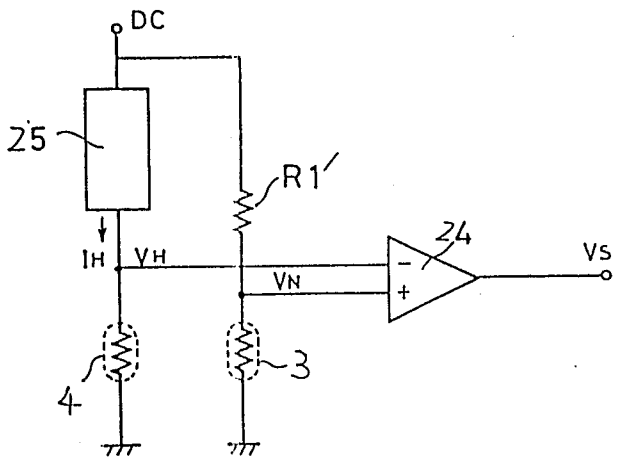
FIG. 4 is a circuit diagram showing a humidity detecting circuit as another embodiment of the present invention.

Another embodiment of the present invention, illustrated in FIG. 4, is a humidity detecting circuit which includes the vapor-detecting humidity sensor involved in the above embodiment.

The humidity detecting circuit as the second embodiment of the present invention is provided with a humidity sensor 1 for detecting the atmospheric humidity. The humidity sensor 1 comprises a first heat sensor 3 for measuring the atmospheric temperature and a second heat sensor 4 which is self-heated or heated by a separate heating source. A comparator 24 is provided in the circuit to compare the detection signal output from the first heat sensor 3 with that from the second heat sensor 4. The first and second heat sensors 3 and 4 have different temperature characteristics so that the voltages (VN, VH) thereacross change at a same rate (ΔVN, ΔVH) only when the atmospheric temperature varies in a constant humidity.

The difference "VN" between the voltage across a current limiting resistor R1' and the voltage across the first heat sensor 3 is input to the positive terminal of the comparator 24. The difference "VH" between the voltage across a current limiting circuit 25 and the voltage across the second heat sensor 4 is input to the negative terminal of the comparator 24. The output "VS" from the comparator 24 is a potential difference between the first and second heat sensors 3 and 4.

The current limiting circuit 25 functions to effect a constant surface temperature of the heated second heat sensor 4. DC constant voltage is applied to the first and second heat sensors 3 and 4.

The humidity detecting method using the humidity sensor comprising two thermistors with an identical temperature characteristics as heat sensors will be described below. Assuming that the voltage across the heated second heat sensor is "VH" and the voltage across the atmospheric temperature-measuring first heat sensor is "VN". The output "VS" of the humidity sensor is a potential difference between "VH" and "VN".

Figure 6:
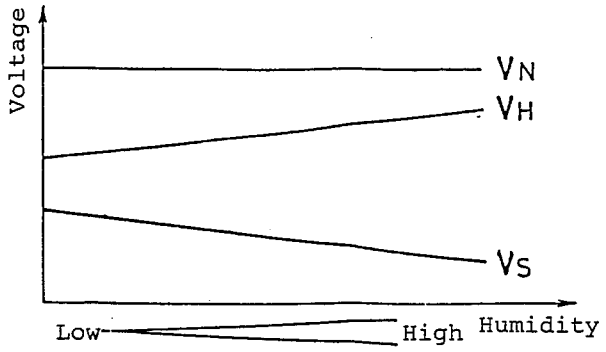
FIG. 6 shows the humidity characteristics (VN, VH and VS) for the case where the humidity alone varies at a constant atmospheric temperature.
Figure 7:
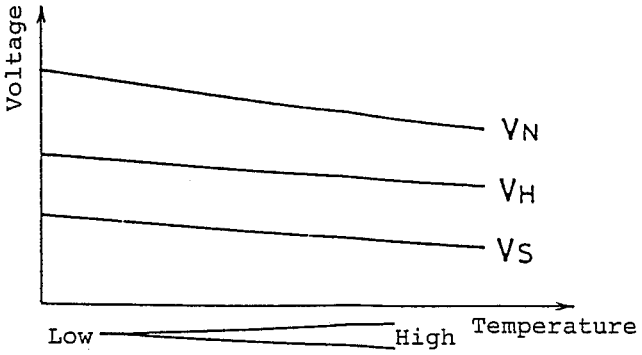
FIG. 7 shows the temperature characteristics (VN, VH and VS) for the case where the atmospheric temperature alone varies in a constant humidity.

FIGS. 6 and 7 show fluctuations of "VH", "VN" and "VS" for various humidities at a constant atmospheric temperature and for various atmospheric temperature in a constant humidity, respectively.

First, fluctuations of "VH", "VN" and "VS" for a constant atmospheric temperature are described with reference to FIG. 6.

[Voltage "VN" across the first heat sensor]

The atmospheric temperature-measuring first heat sensor with small current flow is not self-heated and its resistance depends on the atmospheric temperature. Therefore, the voltage "VN" across the first heat sensor is constant.

[Voltage "VH" across the second heat sensor]

Under 0 g/m$^3$ absolute humidity, the heated second heat sensor presents a thermal equilibrium state according to the following equation which is a modification of the equation (3).

$$VH^2/RH = hm(Tw - Tf) \cdot S \qquad (3A)$$

wherein

VH: voltage across heated second heat sensor

At a constant atmospheric temperature, the mean heat transfer coefficient "hm" increases as the atmospheric humidity rises, and accordingly the value of the right side of the equation (3A) becomes larger. To maintain a thermal equilibrium state, the value of the left side of the equation increases with that of the right side. Since the second heat sensor has a constant surface temperature due to the current limiting circuit, it has a constant electric resistance. Consequently, the voltage "VH" across the second heat sensor rises.

[Output voltage "VS"]

The output voltage "VS" drops gradually according to the calculation of $VS = VN - VH$.

Thus, "VN", "VH" and "VS" have characteristics shown in FIG. 6.

Next, fluctuations of "VN", "VH" and "VS" for various atmospheric temperatures in a constant humidity are described with reference to FIG. 7.

[Voltage "VN" across the first heat sensor]

The resistance of the first heat sensor decreases as the atmospheric temperature increases. Accordingly, the voltage "VN" across the first heat sensor is reduced.

[Voltage "VH" across the second heat sensor]

Under a thermal equilibrium state as expressed by the equation (3A), the value of the right side of the equation (1) decreases as the atmospheric temperature rises. To maintain the thermal equilibrium state, the voltage "VH" across the second heat sensor in the left side of the equation (1) decreases accordingly.

[Output voltage "VS"]

Assuming that the increase rate of the atmospheric temperature is ΔT and the heat radiation to the heated second heat sensor is ΔH, we obtain the equation: $\Delta H = hm \cdot \Delta T$ Assuming that the voltage "VH" across the second heat sensor changes at the rate of "ΔVH" to maintain thermal equilibrium and that heat supply amount changes at the rate of "ΔQ", we obtain the equation: $\Delta Q = \Delta VH^2/RH$ Meanwhile, it is assumed that the voltage "VN" across the first heat sensor changes at the rate of "ΔVN". When the first and second heat sensors have the same temperature characteristics, they receive the same amount of radiation heat "ΔH". However, the voltage change "ΔVH" is not equal to the voltage change "ΔVN" because heat "ΔQ" is supplied to the second heat sensor to maintain the thermal equilibrium state. It will be understood therefore that the output voltage "VS" is susceptible to heat.

In other words, the output voltage "VS" of the humidity sensor depends on both the humidity and the atmospheric temperature.

In detecting the completion of food heated in a heating apparatus such as the microwave oven, on the basis of vapor amount generating from the heated food, the humidity sensor can make an error in the detection because vapor content in the atmosphere and the atmospheric temperature increase with the heating time, hampering the accurate humidity detection.

Figure 5:
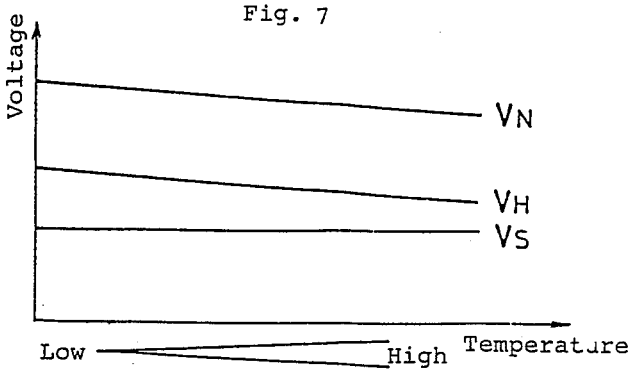
FIG. 5 shows the temperature characteristics (VN, VH and VS) of a humidity sensor composed of heat sensors with different temperature characteristics in accordance with the present invention, under the condition that the atmospheric temperature alone varies.

This is why the humidity sensor of the present invention uses the first and second heat sensors 3 and 4 with appropriately different temperature characteristics, so that "ΔVH" is substantially equal to "ΔVN" as indicated in FIG. 5 when the atmospheric temperature alone varies.

The humidity detecting circuit of the present invention can thus detect the humidity accurately with the output "VS" of the comparator 24 not being susceptible to heat.

It be not intended that the invention is limited by the above example. Various changes and modifications may be made in the invention without departing from the spirit and scope thereof.

As obvious from the above description, the second embodiment of the present invention relates to the humidity detecting circuit comprising the humidity sensor for detecting the moisture content in the atmosphere and which comprises the first and second heat sensors and, the comparator for comparing the detection signals of the first and second heat sensors, the first and second heat sensors having different temperature characteristics so that the change "ΔVN" in the voltage "VN" across the first heat sensor is substantially equal to the change "ΔVH" in the voltage "VH" across the second heat sensor when the atmospheric temperature changes in a constant humidity. It will be appreciated that according to the present invention, therefore, the humidity can be accurately detected by the humidity sensor composed of two heat sensors with different temperature characteristics. It is not necessary to seal one of the two heat sensors in a dry atmosphere as required in the prior art, and accordingly the manufacturing cost is reduced.

In the above embodiment of the invention, the heating apparatus is applied to the microwave oven, though it may be applied to other equipment such as a drier.

In the humidity sensor employed in the present invention, the heated second heat sensor loses its heat in proportion to the vapor content in the atmosphere. With attention paid to this fact, the vapor volume is determined by measuring the heat loss. Meanwhile, the first heat sensor measures the atmospheric temperature to compensate for the temperature fluctuation by the atmospheric temperature, of the second heat sensor.

While only certain embodiments of the present invention have been described, it will be apparent to those skilled in the art that various changes and modifications may be made therein without departing from the spirit and scope of the present invention as claimed.

What is claimed is:

1. An apparatus for heating an object for a controlled heating cycle as a function of the humidity of the atmosphere surrounding the object comprising:

first sensor means, having an electrical resistance which varies with temperature for detecting the temperature of said atmosphere;

second sensor means, having an electrical resistance which varies with temperature, for detecting the vapor content of said atmosphere;

means for heating said second sensor means to a predetermined temperature at a first vapor content of the atmosphere;

means for measuring changes in temperature, as a function of changes in electrical resistance, between said second sensor means and said predetermined temperature, said changes in temperature being proportional to changes in said vapor content as compared to said first vapor content;

comparator means for comparing the temperature of said atmosphere determined by the electrical resistance of said first sensor means with said changes in temperature determined by said second sensor means and generating a heating cycle control signal related to the humidity of the atmosphere; and means responsive to said heating cycle control signal for heating said object for said controlled heating cycle.

2. The apparatus of claim 1 wherein said means for measuring the changes in temperature comprises an amplifier having a first input that receives a voltage signal representative of said predetermined temperature, a second input that receives a voltage signal across the resistance of the first sensor means representative of a temperature of said second sensing means and an output that produces a voltage signal representative of a difference between the voltage signals at said first input and said second input.

3. The apparatus of claim 1 wherein said means responsive to said heating cycle control signal comprises:

memory means for storing information related to the heating of objects, and processing means, responsive to said heating cycle control signal, for calculating additional heating time based on information stored in said memory means.

4. The apparatus of claim 1 wherein said first sensor means is a variable resistance device selected from a group consisting of metal thin film resistors, thermistors and semiconductors.

5. The apparatus of claim 1 wherein said second sensor means is a variable resistance device selected from a group consisting of metal thin film resistors, thermistors and semiconductors.

6. An apparatus for measuring humidity of the atmosphere surrounding an object comprising:

first sensor means, having an electrical resistance which varies with temperature, for detecting the temperature of said atmosphere;

second sensor means, having an electrical resistance which varies with temperature, for detecting the vapor content of said atmosphere;

means for heating said second sensor means to a predetermined temperature at a first vapor content of the atmosphere;

means for measuring changes in temperature, as a function of changes in electrical resistance, between said second sensor means and said predetermined temperature, said changes in temperature being proportional to changes in said vapor content as compared to said first vapor content; and comparator means for comparing the temperature of said atmosphere determined by the electrical resistance of said first sensor means with said changes in temperature determined by said second sensor means and generating a signal related to the humidity of the atmosphere.

7. The apparatus of claim 6 wherein said means for measuring the changes in temperature comprises an amplifier having a first input that receives a voltage signal representative of said predetermined temperature, a second input that receives a voltage signal across the resistance of the first sensor means representative of a temperature of said second sensing means and an output that produces a voltage signal representative of a difference between the voltage signals at said first input and said second input.

8. The apparatus of claim 6 wherein said first heat sensor means is a variable resistance device selected from a group consisting of metal thin film resistors, thermistors and semiconductors.

9. The apparatus of claim 8 wherein said second heat sensor means is a variable reistance device selected from a group consisting of metal thin film resistors, thermistors and semiconductors.

10. An apparatus for cooking an object for a controlled cooking cycle as a function of the humidity of a gaseous atmosphere emitted from the object comprising:

first sensor means, having an electrical resistance which varies with temperature, for measuring the temperature of said atmosphere;

second sensor means, having a resistance which varies with temperature, for measuring the vapor content of said atmosphere;

means for heating said second sensor means to a predetermined temperature at a first vapor content of the atmosphere;

means for measuring changes in temperature, as a function of changes in electrical resistance, between said second sensor means and said predetermined temperature, said changes in temperature being proportional to changes in said vapor content as compared to said first vapor content;

comparator means for comparing the temperature of said atmosphere determined by the electrical resistance of said first sensor means with said changes in temperature determined by said second sensor means and generating a cooking cycle control signal related to the humidity of the gaseous atmosphere emitted from the object; and means responsive to said cooking cycle control signal for heating said object for said controlled cooking cycle.

11. The apparatus of claim 10 wherein said means for measuring the changes in temperature comprises an amplifier having a first input that receives a voltage signal representative of said predetermined temperature, a second input that receives a voltage signal across the resistance of the first sensor means representative of a temperature of said second sensing means and an output that produces a voltage signal representative of a difference between the voltage signals at said first input and said second input.

12. The apparatus of claim 10 wherein said means responsive to said cooking cycle control signal comprises:

memory means for storing information related to the cooking of objects, and processing means, responsive to said cooking cycle control signal, for calculating additional cooking time based on information stored in said memory means.

13. The apparatus of claim 10 wherein said first heat sensor means is a variable resistance device selected from a group consisting of metal thin film resistors, thermistors and semiconductors.

14. The apparatus of claim 10 wherein said second heat sensor means is a variable resistance device selected from a group consisting of metal thin film resistors, thermistors and semiconductors.

15. An apparatus for measuring the humidity in the atmosphere surrounding an object, comprising:

first sensor means for detecting the temperature of said atmosphere;

second sensor means for detecting the vapor content of said atmosphere, wherein said first and second sensor means have respective resistances, the voltage characteristics of which vary at the same rate only when humidity is constant;

means for heating said second sensor means to a predetermined temperature;

means for applying voltages across the respective resistances of said first and second sensor means; and means for comparing a first voltage signal present across said first sensor means and a second voltage signal present across said second sensor means, wherein said means for comparing produces an output indicative of the humidity in the atmosphere.

16. The apparatus of claim 15 wherein said first sensor means is a variable resistance device selected from a group consisting of metal thin film resistors, thermistors and semiconductors.

17. The apparatus of claim 15 wherein said second sensor means is a variable resistance device selected from a group consisting of metal thin film resistors, thermistors and semiconductors.

18. An apparatus for heating an object for a controlled heating cycle as a function of the humidity of the atmosphere surrounding the object, comprising:

first sensor means for detecting the temperature of said atmosphere;

second sensor means for detecting the vapor content of said atmosphere wherein first and second sensor means have respective resistances, the voltage characteristics of which vary at the same rate only when humidity is constant;

means for heating said second sensor means to a predetermined temperature;

means for applying voltages across the respective resistances of said first and second sensor means;

means for comparing a first voltage signal present across said first sensor means and a second voltage signal present across said second sensor means, wherein said means for comparing produces an output indicative of the humidity in the atmosphere; and means, responsive to said output of said means for comparing, for heating said object for said controlled heating cycle.

19. An apparatus for cooking an object for a controlled cooking cycle as a function of the humidity of the gaseous atmosphere emitted from the object, comprising:

first sensor means for detecting the temperature of said atmosphere;

second sensor means for detecting the vapor content of said atmosphere wherein first and second heat sensor means have respective resistances, the voltage characteristics of which vary at the same rate only when humidity is constant;

means for heating said second heat sensor means to a predetermined temperature;

means for applying voltages across the respective resistances of said first and second heat sensor means;

means for comparing a first voltage signal present across said first heat sensor means and a second voltage signal present across said second heat sensor means, wherein said means for comparing produces an output indicative of the humidity in the gaseous atmosphere; and means, responsive to said output of said means for comparing, for cooking said object for said controlled cooking cycle.

* * * * *